United States Patent [19]

Johnson et al.

[11] Patent Number: 4,975,333

[45] Date of Patent: Dec. 4, 1990

[54] METAL COATINGS ON METAL POWDERS

[75] Inventors: James R. Johnson, River Falls; William J. Mueller, Colfax; David R. Walsh, Menomonie, all of Wis.

[73] Assignee: Hoeganaes Corporation, Riverton, N.J.

[21] Appl. No.: 324,233

[22] Filed: Mar. 15, 1989

[51] Int. Cl.[5] ..... B22F 1/00; B22F 1/02; B22F 9/00

[52] U.S. Cl. ..... 428/570

[58] Field of Search ..... 428/570

[56] References Cited

U.S. PATENT DOCUMENTS

| | | | |
|---|---|---|---|
| 1,986,197 | 1/1935 | Harshaw | 428/570 |
| 2,646,456 | 7/1953 | Jacquier | 428/570 |
| 2,679,683 | 6/1954 | Luther, Jr. | 428/570 |
| 2,933,415 | 4/1960 | Homer et al. | 428/570 |
| 3,045,334 | 7/1962 | Berzins | 428/570 |
| 3,260,576 | 7/1966 | Gruene et al. | 428/570 |
| 3,428,442 | 2/1969 | Yurasko, Jr. | 428/570 |
| 3,476,530 | 11/1969 | Ehrreich et al. | 428/570 |
| 3,838,982 | 11/1974 | Sanderon et al. | 428/570 |
| 4,833,040 | 5/1989 | Fishman et al. | 428/570 |

FOREIGN PATENT DOCUMENTS

| | | | |
|---|---|---|---|
| 0302430 | 2/1989 | European Pat. Off. | 428/570 |
| 1521443 | 6/1970 | Fed. Rep. of Germany | 428/570 |
| 47-176612 | 2/1971 | Japan | 428/570 |
| 55-94401 | 7/1980 | Japan | 428/570 |
| 59-50101 | 3/1984 | Japan | 428/570 |
| 59-157205 | 9/1984 | Japan | 428/570 |
| 59-215401 | 12/1984 | Japan | 428/570 |
| 61-79706 | 4/1986 | Japan | 428/570 |
| 61-79707 | 4/1986 | Japan | 428/570 |
| 61-130401 | 6/1986 | Japan | 428/570 |
| 61-186401 | 8/1986 | Japan | 428/570 |
| 62-278203 | 12/1987 | Japan | 428/570 |
| 63-86802 | 4/1988 | Japan | 428/570 |
| 63-89602 | 4/1988 | Japan | 428/570 |
| 63-137102 | 6/1988 | Japan | 428/570 |
| 2080783 | 2/1982 | United Kingdom | 428/570 |

OTHER PUBLICATIONS

Loto, "Electroless Nickel Plating of Iron Powders" Journal of Metals, Aug. 1987, pp. 36–38.

*Primary Examiner*—Theodore Morris
*Assistant Examiner*—David W. Schumaker
*Attorney, Agent, or Firm*—Woodcock, Washburn, Kurtz, Mackiewicz & Norris

[57] ABSTRACT

Methods for manufacturing compressible and sinterable metal powders are provided by this invention which include contacting core metal particles with a sol of a precursor of a metal. The sol has a viscosity of from about $10-10^5$ centipoise and comprises at least 1.0 weight percent of the precursor in a liquid medium. The final coating is produced by removing the liquid from the sol and then converting the precursor to form a substantially uniform layer of a Cu-Ni-Mo alloy on the surfaces of the soft iron or steel core metal particles.

2 Claims, 2 Drawing Sheets

METAL COATINGS ON METAL POWDERS

FIELD OF THE INVENTION

This invention relates to the production of metal powders for use in making articles via powder metallurgy and, more particularly, to providing alloy coatings to these metal powders for improving metallurgical properties.

BACKGROUND OF THE INVENTION

Powder metallurgy has recently been the basis for the development of more efficient and versatile methods of manufacturing structural parts. In the production of metal powders for use in making these parts, it is often desirable to have additional metals on the surface of the base powder particles, so that upon pressing and sintering, desired alloys form along the grain boundaries. One art-recognized technique for accomplishing this result is to coat the particles with a sticky substance and then apply a dusting of the alloying metal ingredients. The core powder particles, coated with alloying metal ingredients, are then heated to produce diffusion-bonded alloy particles on the surface of the core particles. Such pretreated powders have been known to substantially improve the strength-elongation properties of the finished product. However, the application of the alloying metallic elements is not particularly uniform and this is known to influence properties.

Another technique for providing alloying ingredients is to form a melt of the base metal and alloying ingredients prior to powderization. This procedure produces a pre-alloyed powder of excellent uniformity, but such powders are hard and have less compressibility in the green state, and therefore lower density in the sintered state, than do powders that are not pre-alloyed.

While, as a whole, such techniques are indicative of the state of the art for providing alloying elements to metal particles for promoting physical properties, these efforts have not been concerned with particular problems associated with the current developments of powder metallurgy for maximizing structural integrity. Accordingly, there is a need for a procedure for manufacturing core metal particles with a chemically-uniform coating of a metal, an alloy or alloying ingredient, or a series of said coatings applied in a chosen sequence for the promotion of desired grain boundary properties of pressed and sintered products. In particular, there is a need for a highly compressible powder composition of base metal and alloying ingredients in uniform concentrations.

SUMMARY OF THE INVENTION

This invention provides metal coated metal powders and methods for their manufacture. The method of this invention produces compressible and sinterable powders wherein core metal particles are coated with at least one metal, such as an alloying ingredient for the core metal. This method includes the step of providing a sol of a precursor of the metal to be used in the coating material. The sol has a viscosity of about $10-10^5$ centipoise and comprises at least about 1.0 weight percent of the precursor of the metal in a liquid medium based on the weight of the sol. The core metal particles are then contacted with the sol to produce a sol coating on the particles. All or substantially all of the liquid medium is then removed to form a substantially dry coating of said precursor of said coating metal on the core metal particle. The precursor coating is then converted to produce a substantially uniform coating of the metal on the surfaces of the core metal particles.

Accordingly, this invention provides a substantially uniform coating of metal or alloying ingredients on the surfaces of compressible metal particles. The coatings on the individual metal particles ar extremely well dispersed and substantially more uniform than coatings produced by prior art dusting techniques. Moreover, individual alloying ingredients of the alloy coatings can be distributed substantially proportionally around the surface of the individual core metal particles. The invention therefore provides a metallurgical powder composition that provides the excellent uniformity of pre-alloying without the attendant loss of compressibility that traditionally results from pre-alloying.

It is, therefore, an object of this invention to provide sinterable powders having alloying ingredients for improving metallurgical properties without significant losses in compressibility.

It is another object of this invention to provide compressible and sinterable powders having a uniform distribution of alloy coating elements on their surfaces.

With these and other objects in view, which will become apparent to one skilled in the art as the description proceeds, this invention resides in the novel construction, combination, arrangement of materials, and methods substantially as hereinafter described and more particularly defined in the attached claims.

BRIEF DESCRIPTION OF THE DRAWINGS

The accompanying drawings illustrate preferred correlation data for describing the best mode so far devised for the practical application of the principles of this invention, and in which.

DESCRIPTION OF THE INVENTION

Figure 1:
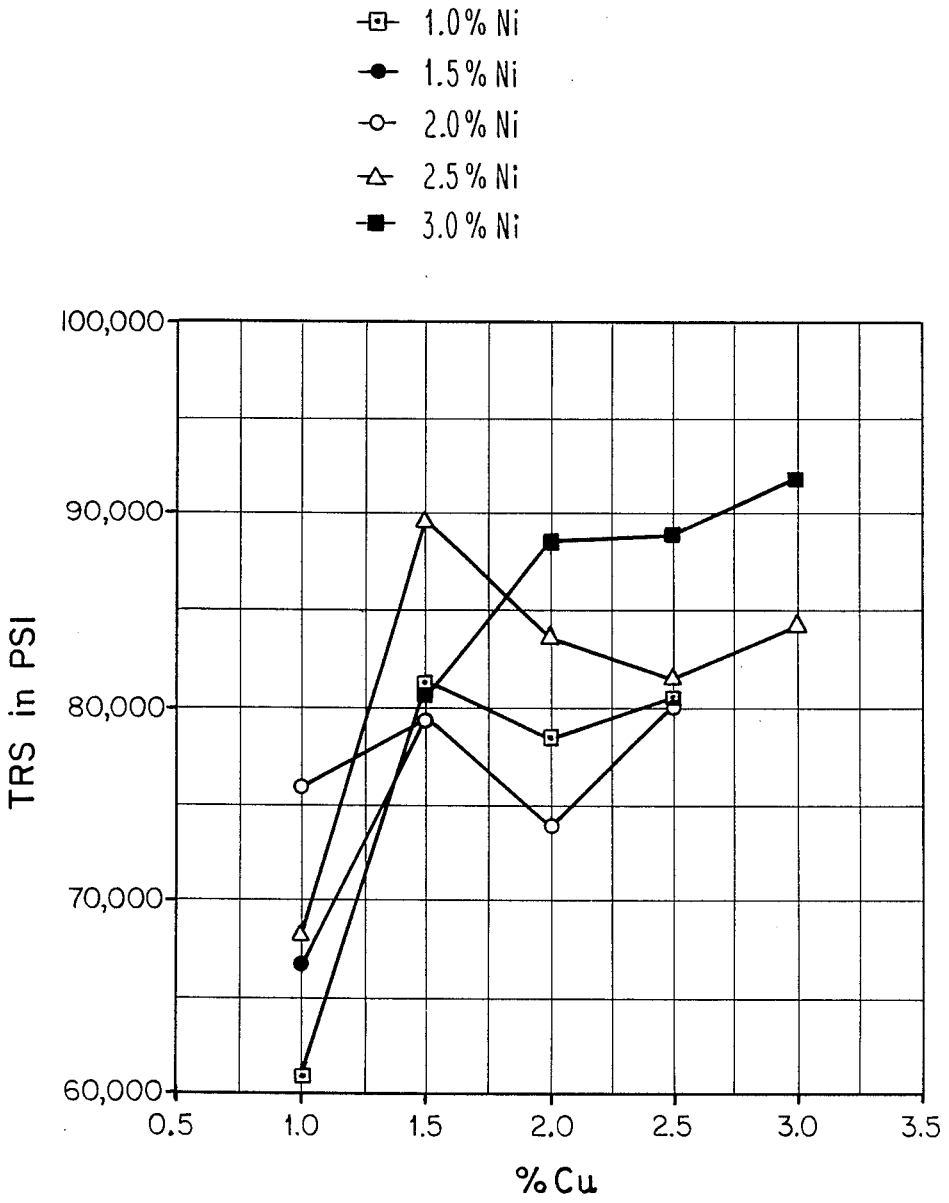
FIG. 1: is a graphical depiction of transverse rupture stress values for various weight percents of nickel and copper on an iron core.

The preferred operable embodiments of this invention will now be described. In one embodiment, the method of manufacturing compressible and sinterable powders is provided wherein core metal particles are coated with at least one metal. The method includes the steps of (1) providing a sol comprising a precursor of the coating metal in a liquid medium wherein the coating metal comprise at least one weight percent of the sol. The sol has a viscosity of about $10-10^5$ centipoise; (2) contacting the core metal particles with the sol to produce a sol coating on the particles; (3) removing substantially all the liquid medium from the sol to provide a substantially dry coating of the precursor of the coating metal on the core metal particles; and (4) converting the precursor to the coating metal to produce a substantially uniform coating of the metal on the surfaces of the core metal particles.

This invention also provides a mixture of metal-coated core metal particles which are compressible at 50,000 psi and sinterable to a density of at least 77% of the theoretical density of the mixture. These particles are characterized by a core metal, preferably iron or steel, coated with a substantially uniform layer of at least one metal, preferably an alloy or a metal capable of forming an alloy with the core metal. As used herein, the "theoretical density" of a powder is the weight-average density of the elemental ingredients, assuming an absence of porosity or impurities.

A general discussion of the various preferred steps of this invention will now be presented. The sol of this invention should be prepared such that it will adhere to the core metal particles while providing sufficient metal or alloying ingredients to form a coating. As used herein, the term "sol" is meant to cover both solutions and fluid colloidal systems containing precursors of the metals found in the final coating. The sol can contain moieties in solution or a suspension that ranges in size from chemical ion complexes to colloids. These moieties constitute the preferred "precursors" of the coating metal. The precursor compound is preferably an oxygen-containing compound of a metal for a desired alloy coating. The most preferred precursor is an oxide or oxygen-containing salt of the desired alloying ingredients. Examples of precursor compounds are metal salts of lower alkyl carboxylic acids, for example, acetates, formates, propylates or lactates; oxalates; citrates; or metal salts of mineral acids (e.g. nitrates, chlorides, sulfates, and phosphates). Generally, the precursor of the metal is added to a liquid medium, such as water, in an amount of at least about 1.0 weight percent up to about sol weight percent, of the the sol. However, the total solids in the liquid medium can be calculated so that the molar proportions of the metal elements in the solution yield a desired alloy coating on the metal particles. It is also preferred that the precursor compound in the sol be in the form of sub-micron colloids of about 10–500 angstroms, and more preferably about 50–100 angstroms, for providing chemical uniformity. The sol should have a viscosity sufficient to enable it to adhere to the core metal particles and to provide a desired coating thickness, preferably about 10–10,000 centipoise, preferably 50–5000 centipoise, and more preferably about 100–500 centipoise, as measured at the temperature at which it is contacted with the core metal particles.

The core metal particles are contacted with the described sols to produce a coating of the sol on the core particles. The thickness of the coating, and therefore the relative amounts of alloying metals and core metal, can be adjusted by varying the viscosity of the sol, as explained below. This process yields precursor particles in a viscous sol that preferably uniformly and completely coat the particle surface. It is understood that contacting of the core metal particles with the sol to provide a sol coating can be performed with varied conventional techniques. Fluidized bed technology is preferred from a manufacturing standpoint, but simple wash coatings, spray coating, and flow coating can also be favorably employed.

The sols of this invention can be concentrated to a desired viscosity level by heating. Further heating, preferably in an inert gas, can drive off the liquid medium and/or decompose precursor compounds, such as salts into oxides as will be further described below. It has been further determined that certain precursor salts and core metal particles will react during mixing in a liquid medium, i.e., iron core powder and nitrates of copper and nickel. Such reactions may produce their own heat sufficient to drive off both the liquid medium and the water of hydration. This mechanism is also considered part of the liquid removing step.

The converting step of this invention is designed to provide a substantially uniform coating of a metal or alloy on the surfaces of the core metal particles. It is understood that the converting step can include the substeps of (1) heating a precursor salt to form an oxide of the metal or alloying ingredient and (2) reducing this oxide to a metal. When the precursor is itself an oxide, the converting step simply includes reducing the precursor oxide of the metal to form a substantially uniform coating of the metal or alloying ingredient on the core metal particle. The converting step ca include both heating in the presence of air and/or heating in the presence of a suitable reducing medium. In the preferred embodiment, heating of oxide-coated core metal particles in the presence of hydrogen produces a uniform layer of metallic elements on the particles. Reduction of the oxide can also be effected solely by chemical means eliminating the need to heat the oxide-coated particles. Such chemical reduction techniques can include, for example, reactions in the presence of reducing agents and/or electrochemical reduction. The reducing "agents" can be liquids, solids or gases. The converting step can further comprise a variety of oxidation and reduction steps which can be subsequently followed by additional sol coating steps to provide a plurality coating of layers having selected compositions and thicknesses. For instance, a coating can be diffused, partially or wholly, into the core particle via heating prior to applying a subsequent coating.

A more detailed understanding of this invention may be derived from the following particular embodiments of the method. A nitrate-coating procedure has been developed within the context of this invention. Metal nitrates are primarily used as the sources of copper and nickel since they are readily available, are extremely water soluble, and decompose upon heating to form the oxides of the metal itself. The oxides that form from a mixture of metal nitrates are themselves intimately mixed and upon reduction (annealing) can form intimate mixtures of metals.

This method was demonstrated by forming a thin, relatively uniform coating of copper and nickel on Ancorsteel® 1000B iron powder, pure iron powder having trace element impurities commercially available from Hoeganaes Corporation, Riverton, N.J. The "recipe" for the preparation of about 500 g. of this coated powder, with end-product alloy weight percents of about 1.6% copper, 1.8% Ni, and 0.5% Mo, is as follows:

1. Admix 40 grams of nickel (II) nitrate hexahydrate, 26.6 grams of copper (II) nitrate 2.5 hydrate, 3.4 grams of molybdenum trioxide, and 30 mL water.
2. Mix until a solution of the nitrates, with the molybdenum trioxide powder evenly dispersed in the solution, is formed.
3. Add 454 grams of iron powder to the above mixture and continue to mix thoroughly for about 2 to 3 minutes.
4. Discontinue mixing and allow the system to stand for about 30 minutes until a reaction begins between the iron powder and the nitrate-coating mixture. (Heating the mix gently to about 50 or 60 degrees centigrade can accelerate the initiation of this reaction.) The heat produced from the reaction is sufficient to drive off the originally added water as well as the waters of hydration of the copper and nickel nitrates, and most of the nitrogen oxides. [Carrying out the mixing process and subsequent reaction between the iron powder and the nitrates in an inert atmosphere results in less conversion of iron to iron oxide and requires less hydrogen in the following annealing step.]

5. Upon cooling, the black-colored, oxide-coated powder is annealed in a hydrogen atmosphere to produce an iron powder with a mixed-metal coating as follows.
   (a) Place the samples, in ceramic boats, into a Vycor tube.
   (b) Purge the tube with hydrogen and then begin heating.
   (c) Heat to 750° C. and maintain for about 60 minutes.
   (d) Cool in hydrogen to about room temperature and remove.

The copper and nickel within the coating of the above-described method are evenly distributed across the surface of the powder and the molybdenum is localized in "spots" corresponding to the locations of molybdenum trioxide particles in the original coating mixture. The molybdenum trioxide did not dissolve in the solution formed from water, copper nitrate and nickel nitrate. For this reason, the coating is homogeneous with respect to copper and nickel, but heterogeneous with respect to molybdenum. Subsequent to annealing, the product powder may be screened to achieve an appropriate particle size distribution.

The sources for the metals used to coat A1000B in this nitrate method can be varied from the copper and nickel nitrates and molybdenum trioxide used in the described general process. The use of alternate sources has some impact on the characteristics of the final coated powder and on process controls in the production of this final product. In Table I below, the transverse rupture stress (TRS) values for identically produced test bars made with coated iron powders using different metallic precursor compounds are compared. The proportions of the metallic precursors were set so that the end product iron powder contained 6% Cu, 1.8% Ni, and 0.5% Mo (theoretical density of about 7.90 g./mL). Variations in the sources of the alloying metals and in the processes associated with the choices of starting materials apparently caused some differences in the characteristics of the end product. In each of the following tests, which were performed solely for comparison purposes and not for maximum strength, the adoptive standard for preparing test bars was as follows:

1. Thoroughly mix the metal powder with 0.75% Acrawax and 0.6 wt.% graphite.
2. Weigh out 10.0 grams of the mixed sample.
3. Press the sample in the die to 50,000 psi.
4. Measure the bar dimensions and reweigh the bar.
5. Sinter in hydrogen at 1120° C. for about 60 minutes.
6. Cool the bar in hydrogen to about room temperature.
7. Measure the bar dimensions and reweigh the bar.
8 Test the bar for TRS and other tests as warranted.

TABLE I

| |
|---|
| Copper and Nickel Nitrates: |
| Copper nitrate, nickel nitrate, molybdenum trioxide, A1000B. |
| Sample "Production" sintered density = 6.1 g/mL; TRS = 81000 psi. |
| Copper nitrate, nickel nitrate, molybdenum pentachloride, A1000B. |
| Sample C10R; sintered density = 6.49 g/mL; TRS = 99000 psi. |
| Copper nitrate, nickel nitrate, ammonium molybdate, A1000B. |
| Sample 288BR; sintered density = 6.40 g/mL; TRS = 79000 psi. |
| Copper nitrate, nickel nitrate, iron molybdate, A1000B. |

TABLE I-continued

| |
|---|
| Sample B46B; sintered density = 6.49 g/mL; TRS = 87000 psi. |
| Copper and/or Nickel Acetates: |
| Copper acetate, nickel nitrate; 0.5% molybdenum alloyed in iron powder as molybdenum source. |
| Sample B40; sintered density = 6.30 g/mL; TRS = 68000 psi. |
| Copper acetate, nickel acetate; 0.5% molybdenum alloyed in iron powder as the molybdenum source. |
| Sample B39; sintered density = 6.30 g/mL; TRS = 70000 psi. |
| Copper nitrate, nickel acetate; 0.5% molybdenum alloyed in iron powder as molybdenum source. |
| Sample B41B; sintered density = 6.26 g/mL; TRS = 71000 psi. |
| Sample B41C; sintered density = 6.11 g/mL; TRS = 60000 psi. |
| Copper and/or Nickel Carbonates: |
| Copper carbonate, nickel nitrate; 0.5% molybdenum alloyed in iron as molybdenum source. |
| Sample 285R; sintered density = 6.24 g/mL; TRS = 83000 psi. |
| Copper carbonate, nickel nitrate, molybdenum trioxide, A1000B. |
| Sample 286R; sintered density = 6.46 g/mL; TRS = 89000 psi. |
| Copper carbonate, nickel nitrate, ammonium molybdate, A1000B. |
| Sample 291R; sintered density = 6.49 g/mL; TRS = 94000 psi. |
| Copper carbonate, nickel nitrate, molybdenum pentachloride, A1000B. |
| Sample 293BR; sintered density = 6.38 g/mL; TRS = 95000 psi. |
| Copper and Nickel Chlorides: |
| Copper chloride, nickel chloride; 0.5% molybdenum alloyed in iron as molybdenum source. |
| Sample B38; sintered density = 6.53 g/mL; TRS = 84000 psi. |

Most preferred for a high TRS is the use of copper and nickel nitrates as the sources for copper and nickel and of molybdenum pentachloride as the source of molybdenum. The sintered density appeared greatest in the chloride example which resulted in a figure of about 83% of the theoretical density. The lowest sintered density reported was 6.1 g/mL, for the Production sample, which corresponds to about 77% of the theoretical density.

The surface of the core powder may be modified before mixing with the nitrates or other compounds to improve certain properties. Preoxidation to form a magnetite surface is one example. Alternatively, this invention anticipates adding iron nitrate hydrate and/or with copper and nickel hydrates as a modifying agent for the coating process.

The percent of copper and nickel in the coating of the powder product can be varied by changing the molar proportions of copper and nickel in the sol. FIG. 1 describes the results of mechanically testing various selected combinations of copper and nickel weight percents in coatings produced by the previously described nitrate method on iron powder containing prealloyed 0.5% Mo. TRS values were found to maximize above about 0.5 wt% Ni and 1.5 wt.% Cu. In particular, significant and unexpected improvements in TRS were found at 2.5 wt.% Ni/1.5 wt% Cu; 3.0 wt.% Ni/2.0 wt.% Cu, 3.0 wt.% Ni/2.5 wt.% Cu; and 3.0 wt.% Ni/3.0 wt.% Cu. However, it is expected that 1.8 wt.% Ni/1.5 wt.% Cu/0.5 wt.% Mo and 4.0 wt.% Ni/1.5 wt.% Cu/0.5 wt.% Mo would be valuable commercially.

The preparation of the copper and nickel nitrate precursors or mixture of precursors can be effected by any conventional means. This invention contemplates intimate grinding of precursor materials alone or in combination with heating the premixed nitrates to the melting point of nickel nitrate hydrate (about 50° C.) and dissolving copper nitrate in the melt with subsequent cooling and solidification. As a variation of this step, the premixed nitrates can be heated from the melting point of the nickel nitrate (with concurrent dissolution of the nitrate), followed by rapid quenching to produce a viscous sol. A sol produced by this latter method, however, is stable only for a short time, in the order of minutes, before crystallization occurs. One should avoid adding water before quenching for this produces a more rapid crystallization.

Figure 2:
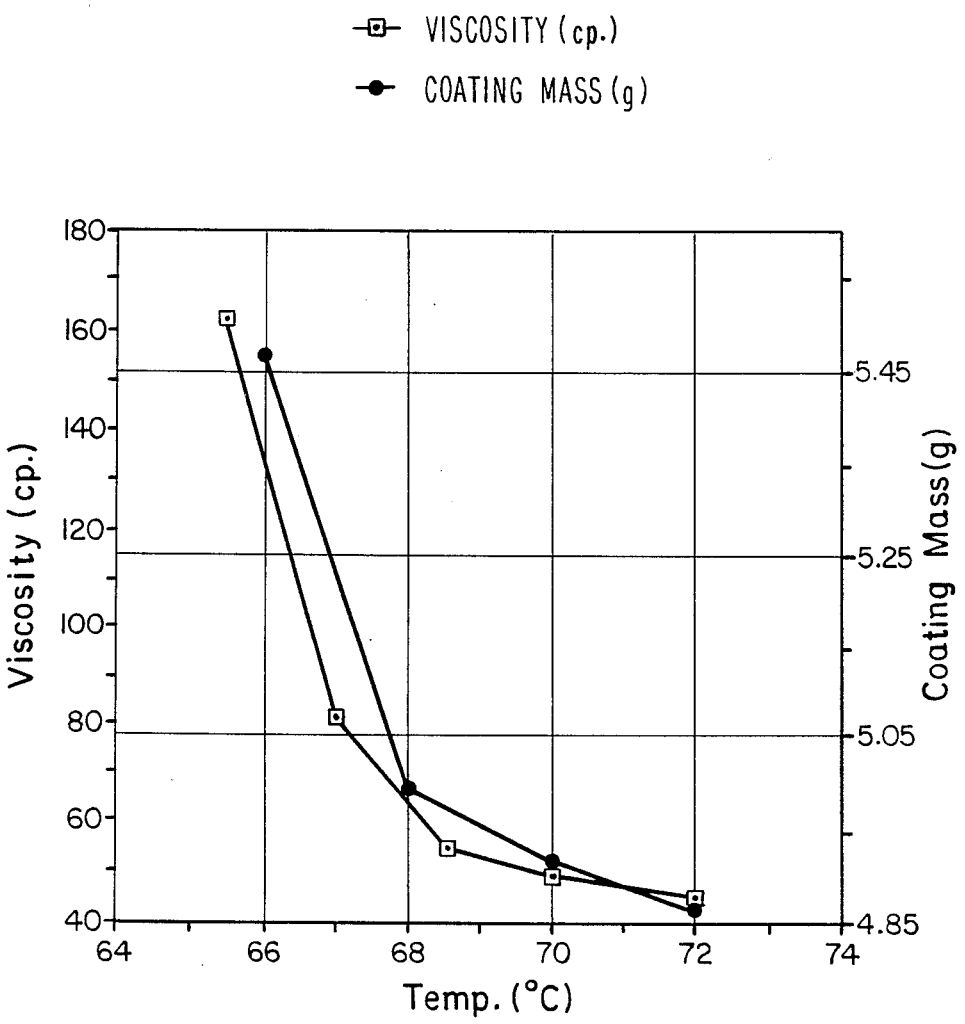
FIG. 2: is a graph showing sol viscosity and coating mass vs. temperature for a sol comprising nitrates of copper and nickel.

As part of this invention, it has also been found that the thickness of the sol coating, and ultimately of the metal coating, on the core metal particles is dependent on the viscosity of the sol. The viscosities of copper and nickel nitrate solutions prepared by heating the nitrate hydrates to the point where they dissolved in their waters of hydration were measured as a function of temperature. Iron powder was mixed with a substantial excess of a solution of known viscosity. The coated particles were magnetically separated from the solution and the mass of the coating material was determined. It was clearly shown, per FIG. 2, that the measured mass of coating correlated with the viscosities of the coating solutions. A practical maximum coating mass based on the results from viscosity studies is about 5.5 grams of mixed copper and nickel nitrates per 5.0 grams of iron powder Ancorsteel® 1000B. It must be recognized, however, that this feature is dependent on the available surface area of the core metal particles. This occurs at a temperature of 66° C., the maximum viscosity of the solution as shown in FIG. 2. The calculated masses of copper and nickel in the 5.5 grams of mixed nitrates is 0.60g. copper and 0.67g. nickel. The calculated maximum percents of copper and nickel in a mixed metal-coated iron powder would be about 9.6% copper and 10.7% nickel.

The structure of iron particles coated by the nitrate process described above was determined by SEM and X-ray analysis. The core is iron with little copper, nickel or molybdenum diffused into it. The iron core is evenly coated with a layer of mixed copper and nickel, which are probably in solution. The layer is about 2 microns thick. Molybdenum is found randomly located in "spots" on the surface. These "spots" correspond to the locations of small molybdenum trioxide particles that were dispersed but not dissolved in the mixed nitrate solution of the initial coating step. It was also discovered that use of soluble molybdenum precursor produced a coated powder particle with molybdenum evenly dispersed on the surface as well. On the basis of these results, it is projected that the disclosed chemical process will enable production of a powder with an even coating of any or all of the alloy metals to the specifications of the end user.

The procedure used in the analysis of the chemical constituents for this invention will now be described. A weighed sample of the metal-containing material is dissolved with heating in mixed nitric and hydrochloric acids. Sodium sulfate is added to the solution, equivalent to 1000 ppm in the solution. The solution is transferred to a 200 mL volumetric flask and diluted to the mark with Milli-Q water. This solution is thereby diluted to a ratio of 1:10 with Milli-Q water and analyzed using the IL Model S-12 Atomic absorption Spectrophotometer and appropriate lamps. Four or five point calibration curves are used to relate instrument output to the weight percent of the metals in the solutions. It wa discovered during analytical testing that the metals content in the end product was proportionally related to the metals content in the precursor compounds.

Although not committed to any particular theory, the inventors believe the rate of the redox reaction to be sensitive to several process parameters, such as the identity of the liquid medium. The relative rate for a redox reaction between copper chloride and Ancorsteel® 1000B as a function of liquid medium can be described as follows:

Water > Methanol > 2-propanol > Ethylene glycol

Accordingly, the reaction with water is very rapid, occurring almost on contact with minimal time for mixing. Methanol is almost as rapid, and ethylene glycol is reasonably slow, allowing time for thorough mixing before the reaction is complete.

Another parameter is the surface preparation of the iron particles themselves. Magnetite-coated iron particles react less rapidly and more uniformly. Stearic acid coatings on iron particles inhibit the redox reaction on the parts of the surface that remain coated during the treatment process. It was noted in one test that a blotchy copper coating was generated on spherical iron particles which were coated with stearic acid prior to contact with the copper solution, whereas a controlled reaction using iron particles without a stearic acid coating produced a very even copper coating. It is further noted that prior coating of iron particles with nickel does not appear to hamper the redox reaction when step-coated particle production processes were attempted.

Although nitrate methods have been described, this invention is equally applicable to sol-gel techniques employing, for example polyester matrix sols, alcohol-based sols, and dextran-based sol-gel solutions. Such procedures are described in U.S. Pat. Nos. 3,790,706; 4,125,406; and 4,349,456, which are herein incorporated by reference. The sol-gel formulas can be used to coat the core metal particles described herein, which in turn, can then be heated to their oxide form and then reduced to metal.

From the foregoing, it can be realized that this invention provides a new process for making improved coated particles and powders that provide a compressible core having alloying elements surrounding it. The invention enables metals fabricators to readily press parts made from these coated particles and subsequently harden the part by heat treatment or diffusion. The coating process of this invention has the added advantages of providing a controlled alloy coating thickness by varying the viscosity of a sol. Although various embodiments have been illustrated, this was for the purpose of describing, but not limiting the invention. Various modifications, which will become apparent to one skilled in the art, are within the scope of this invention described in the attached claims.

I claim:

1. A highly compressible mixture of metal-coated core metal particles, said particles having a core of soft iron or steel coated with a substantially uniform continuous layer comprising at least about 1.5 wt.% Cu, at least about 2.5 wt.% Ni and about 0.5 wt.% Mo based on the total weight of said particle and said coating.

2. The metal-coated core metal particles of claim 1 wherein said coating comprises an alloy.

* * * * *

UNITED STATES PATENT AND TRADEMARK OFFICE

CERTIFICATE OF CORRECTION

PATENT NO. : 4,975,333

DATED : December 4, 1990

INVENTOR(S) : James R. Johnson et al

It is certified that error appears in the above-identified patent and that said Letters Patent is hereby corrected as shown below:

Column 3, line 27; first occurrence of "sol" should read -- "80" --

Column 4, line 11; "ca" should read -- "can" --

Column 5, line 39; "6%" should read -- "1.6%" --

Column 6, line 60; "0.5 wt%" should read -- 1.5 wt.% --

Column 8, line 2; "wa" should read -- "was" --

Signed and Sealed this

Ninth Day of June, 1992

*Attest:*

*Attesting Officer*

DOUGLAS B. COMER

*Acting Commissioner of Patents and Trademarks*